US006379731B1

(12) United States Patent
Brown et al.

(10) Patent No.: US 6,379,731 B1
(45) **Date of Patent: *Apr. 30, 2002**

(54) METHODS FOR VACUUM GAS FLUSH TREATMENT OF FRESH PRODUCE

(75) Inventors: Richard S. Brown, Chualar; Eugene D. Rizzo, Monterey, both of CA (US)

(73) Assignee: Fresh Express, Inc., Salinas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/507,504

(22) Filed: Feb. 18, 2000

(51) Int. Cl.[7] ..... B65B 31/02

(52) U.S. Cl. ..... 426/392; 426/404; 426/418; 426/419; 426/410; 426/106; 53/434; 53/512

(58) Field of Search ..... 426/404, 418, 426/419, 392, 263, 106, 415, 410; 53/432, 433, 434, 39, 512; 383/80

(56) References Cited

U.S. PATENT DOCUMENTS

| | | | | |
|---|---|---|---|---|
| 910,882 A | | 1/1909 | Truesdell | |
| 1,661,602 A | | 3/1928 | Dary | |
| 2,003,326 A | | 6/1935 | Wellman | |
| 2,170,378 A | | 8/1939 | Orstrom | |
| 2,214,944 A | | 9/1940 | Vogt | |
| 2,294,668 A | | 9/1942 | Karas | |
| 2,335,913 A | | 12/1943 | Buttery | |
| 2,424,693 A | | 7/1947 | Jones | |
| 2,611,709 A | | 9/1952 | Plagge | |
| 2,627,862 A | | 2/1953 | Flusher | |
| 2,638,263 A | * | 5/1953 | Jesnig | 383/103 |
| 2,815,621 A | | 12/1957 | Carter | |
| 2,920,967 A | | 1/1960 | Heinemann | |
| 2,925,210 A | | 2/1960 | Fallert | |
| 2,955,940 A | | 10/1960 | Williams | |
| 2,967,777 A | | 1/1961 | Grindrod | |
| 3,055,568 A | | 9/1962 | Zalking | |

(List continued on next page.)

FOREIGN PATENT DOCUMENTS

| | | |
|---|---|---|
| CA | 1025786 | 2/1978 |
| DE | 2842204 | 4/1980 |
| EP | 025334 | 1/1988 |
| GB | 402436 | 12/1933 |
| GB | 764796 | 1/1957 |
| GB | 1378140 | 12/1974 |
| JP | 60-126032 | 7/1985 |

OTHER PUBLICATIONS

Wiley Encyclopedia of Packaging Technology J. Wiley & Sons, 1986 pp. 24–29, 66–81.

Packaging, Japan, Nov. 198, pp. 17–22.

Chemcial Engineering, vol. 64.

Modern Packaging, Aug. 1941, pp. 44, 45.

"The King PAK" eight sided fiberboard IBC from Packaging Review , May 1980, 1 page.

The Wiley Encyclopedia of Packaging Technology (WFPT), John Wiley & Sons, 1986, p. 493.

*Primary Examiner*—Milton I. Cano
*Assistant Examiner*—Robert Madsen

(57) ABSTRACT

A closure system for attachment to and use in gas flushing a container of fresh produce includes a body portion, a closure connected to the body portion, and a pressure-sensitive mechanism connected to the body portion and to the closure that moves the closure to an open position or to a closed position, depending on the pressure exerted on said mechanism.

3 Claims, 14 Drawing Sheets

U.S. PATENT DOCUMENTS 3,128,934 A 4/1964 Jacke
3,203,437 A 8/1965 Faust
3,204,825 A 9/1965 Underwood
3,220,157 A 11/1965 Buchner
3,261,533 A 7/1966 Ripking
3,407,078 A 10/1968 Schlichter
3,419,400 A 12/1968 Hayhurst et al.
3,450,542 A 6/1969 Badran
3,473,589 A 10/1969 Gotz
3,484,017 A 12/1969 O'Donnell
3,521,806 A 7/1970 Esty
3,693,314 A * 9/1972 Reid et al. ..... 53/22 B
3,715,860 A 2/1973 Esty
3,747,614 A 7/1973 Buedingen ..... 134/109
3,939,287 A 2/1976 Orwig et al. ..... 426/316
3,945,558 A 3/1976 Elder ..... 229/23 R
3,957,179 A 5/1976 Bamburg et al. ..... 222/528
3,990,358 A 11/1976 Cade ..... 99/534
3,991,543 A 11/1976 Shaw ..... 53/373
4,001,443 A 1/1977 Dave ..... 426/106
4,006,561 A 2/1977 Toma et al. ..... 47/58
4,039,350 A 8/1977 Bucy ..... 134/22 R
4,055,931 A 11/1977 Myers ..... 53/22 B
4,061,785 A 12/1977 Nishino et al. ..... 426/124
4,066,401 A 1/1978 Solomon ..... 21/61
4,079,152 A 3/1978 Bedrosian et al. ..... 426/124
4,089,417 A 5/1978 Osborne ..... 206/600
4,105,153 A 8/1978 Locke ..... 229/23 R
4,168,597 A 9/1979 Cayton ..... 53/127
4,181,146 A * 1/1980 Goglio ..... 137/493.6
4,209,538 A 6/1980 Woodruff ..... 426/314
4,224,347 A 9/1980 Woodruff ..... 426/106
4,241,558 A 12/1980 Gidewall et al. ..... 53/79
4,258,848 A 3/1981 Akao et al. ..... 206/524.2
4,268,555 A 5/1981 Kantz ..... 485/35
4,296,860 A 10/1981 Hsu et al. ..... 206/386
4,343,429 A 8/1982 Cherry ..... 229/38
4,411,921 A 10/1983 Woodruff ..... 426/263
4,422,466 A 12/1983 Schafer ..... 134/55
4,423,080 A 12/1983 Bedrosian et al. ..... 426/124
4,454,945 A 6/1984 Jabarin ..... 206/524.3
4,515,266 A 5/1985 Myers ..... 206/205
4,516,692 A 5/1985 Croley ..... 222/5
4,610,885 A 9/1986 Tait ..... 426/130
4,670,227 A 6/1987 Smith ..... 422/297
4,702,408 A 10/1987 Powlenko ..... 229/101
4,744,199 A 5/1988 Gannon ..... 53/434
4,744,203 A 5/1988 Brockwell et al. ..... 53/512
4,756,417 A 7/1988 Teixeira ..... 206/386
4,759,642 A 7/1988 Van Erden et al. ..... 383/63
4,813,791 A 3/1989 Cullen et al. ..... 383/40
4,840,271 A 6/1989 Garwood ..... 206/213.1
4,863,287 A 9/1989 Marisk ..... 383/113
4,886,372 A 12/1989 Greengrass et al. ..... 383/100
4,930,906 A 6/1990 Hemphill ..... 383/89
4,962,777 A 10/1990 Bell ..... 134/63
4,963,287 A 10/1990 Hutchings et al. ..... 252/187.23
4,967,776 A 11/1990 Folmar ..... 134/57 R
4,999,978 A * 3/1991 Kohlbach et al. ..... 53/512
5,044,776 A 9/1991 Schramer et al. ..... 383/89
5,078,509 A 1/1992 Center et al. ..... 383/88
5,093,080 A 3/1992 Keller ..... 422/40
5,121,589 A 6/1992 Ventura et al. ..... 53/448
5,226,972 A 7/1993 Bell ..... 134/25.1
5,290,580 A 3/1994 Floyd et al. ..... 426/524
5,316,778 A 5/1994 Hougham ..... 426/324
5,346,089 A 9/1994 Brown et al. ..... 220/403
5,354,569 A 10/1994 Brown et al. ..... 426/411
5,402,906 A 4/1995 Brown et al. ..... 220/403
5,421,250 A 6/1995 Beaumont ..... 99/636
5,437,731 A 8/1995 St. Martin ..... 134/10
5,522,410 A 6/1996 Meilleur ..... 134/57 R
5,640,643 A 6/1997 Hoitz et al. ..... 396/661
5,713,101 A 2/1998 Jackson ..... 15/302
5,727,690 A 3/1998 Hofmeister ..... 209/139.1
5,728,439 A 3/1998 Carlblom et al. ..... 428/36.91
5,885,002 A 3/1999 Reiss ..... 383/37
5,954,067 A 9/1999 Brown et al. ..... 134/125.3
6,041,797 A 3/2000 Casselman ..... 134/152
6,189,299 B1 * 2/2001 Brown et al. ..... 53/512

* cited by examiner

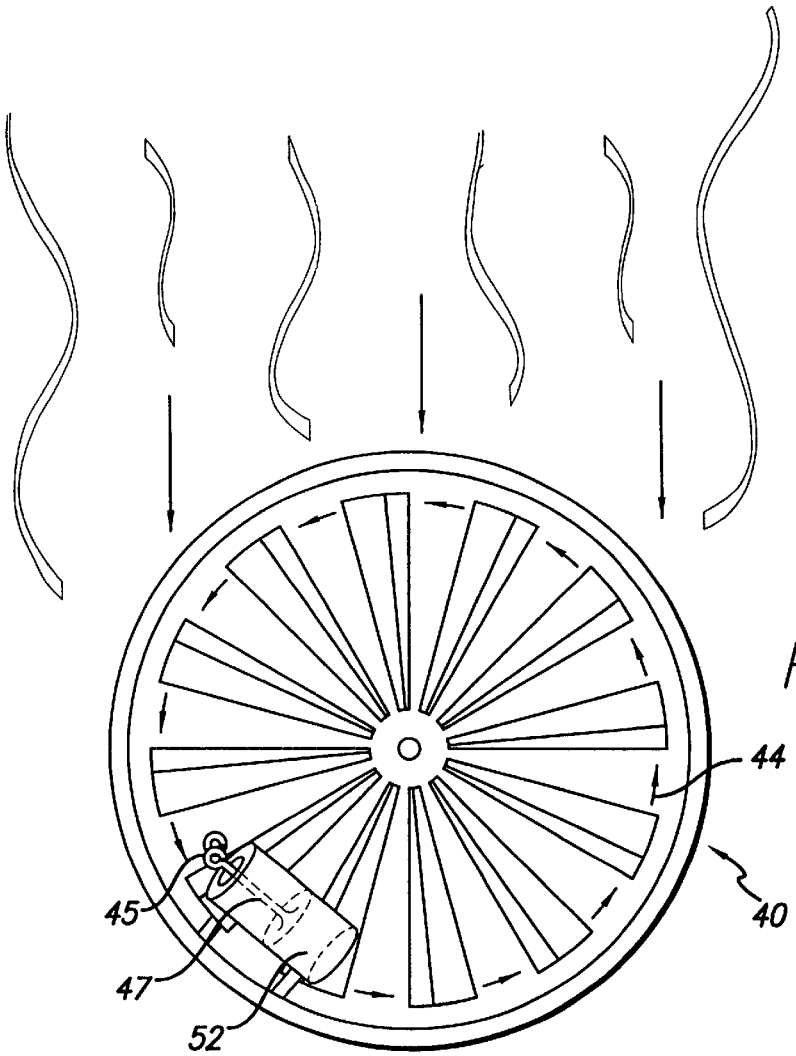
FIG. 4C
FIG. 4D
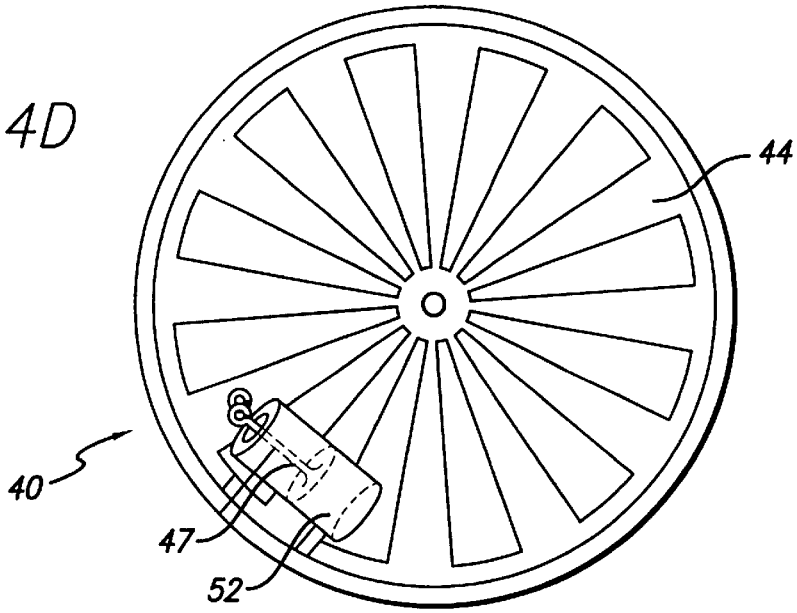

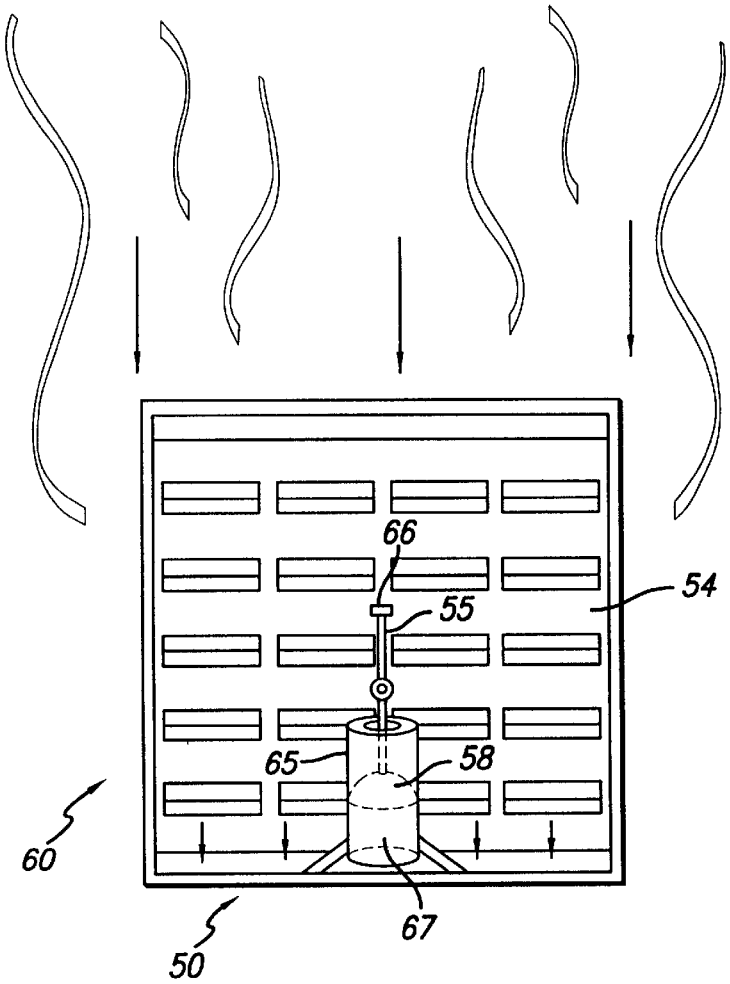
FIG. 5E
FIG. 5F
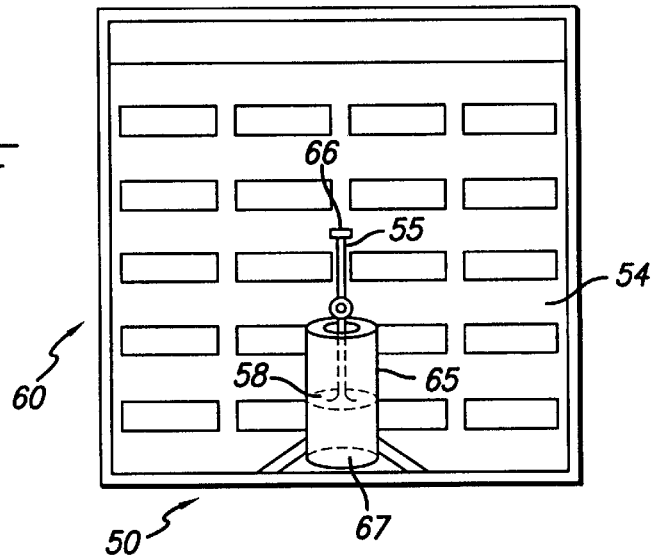

METHODS FOR VACUUM GAS FLUSH TREATMENT OF FRESH PRODUCE

This invention relates to methods and apparatus for gas flush treatment of fresh leafy produce in a vacuum chamber. More particularly, the invention relates to methods and apparatus for flushing one or more containers of fresh, leafy produce with one or more gases such as nitrogen in a vacuum chamber utilizing, on each of said containers, a closure system that can be attached to and detached from such a container. This system includes a closure that opens inside a vacuum chamber when the pressure inside the chamber is reduced below atmospheric pressure, and closes when the pressure inside the chamber is at or near atmospheric pressure.

The closure system is of a size and shape adapted for attachment to the opening at the top of containers of fresh leafy produce. Each of these containers preferably includes a liner bag to hold such produce. For attachment to each of these bags, the closure system includes a body portion, a closure connected to the body portion, and a mechanism connected to the closure and to the body portion that moves the closure from an open position to a closed position, and vice versa. This mechanism includes a sealed container, such as a bellows or bladder, of gas, e.g. air preferably at a pressure at or near to atmospheric pressure. This sealed container is connected to one or more arms that move the closure between open and closed positions when the gas inside the sealed container expands or contracts. Expansion and contraction occurs, for example, as the pressure in a vacuum chamber containing produce containers with attached closure systems falls from or rises to atmospheric pressure.

In preferred embodiments, the mechanism includes a first arm movably connected at one end to the internal side wall of the body portion, and to the sealed container at the other end, and a second arm movably connected to the inner surface of the closure at one end, and to the sealed container at the other end. The closure can be hinged to the body portion of the closure device, or can be attached to the inner surface of the body portion. Contraction of the gas inside the sealed container moves these arms and the connected closure to the closed position. Expansion of the gas inside the container moves these arms and connected closure to the open position.

The body portion has a size and shape adapted to be removably attached to the open end of a container of fresh produce. The body portion preferably includes a cylindrical, proximal portion connected to the closure at one end, and a distal portion that fits on or over a produce container.

In operation, a closure system is sealingly attached, by twist-ties, tape or otherwise, to the top of a container of fresh produce. Each container with its attached closure system is placed into a vacuum chamber, and the vacuum chamber is closed to the outside atmosphere. A vacuum is drawn upon the interior of the chamber, reducing the pressure on each container within the chamber. As the pressure drops below atmospheric pressure inside the chamber, the air inside the sealed container of each mechanism expands, moving the closure to an open position. Upon opening, the pressure inside each of the containers of fresh produce falls to the pressure within the chamber itself.

When the pressure inside the chamber and each container has reached a desired level, the chamber is filled with a desired gas e.g. nitrogen, or a gas mixture, until the pressure inside the chamber, and inside each container inside the chamber, rises to or near atmospheric pressure. At this pressure, the sealed container connected to each arm mechanism contracts, moving the closure of each closure system to a closed position, trapping the desired gas atmosphere inside each produce container.

BRIEF DESCRIPTION OF THE DRAWINGS

The invention can better be understood by reference to the drawings in which:

FIGS. 4A, 4B, 4C, 4D, 4E, and 4F show a fourth closure system embodiment with a vacuum cylinder-driven arm/closure; and FIGS. 5A, 5B, 5C, 5D, 5E, and 5F show a fifth closure system embodiment with a second vacuum cylinder-driven arm/closure.

DETAILED DESCRIPTION OF THE DRAWINGS

Figure 1A:
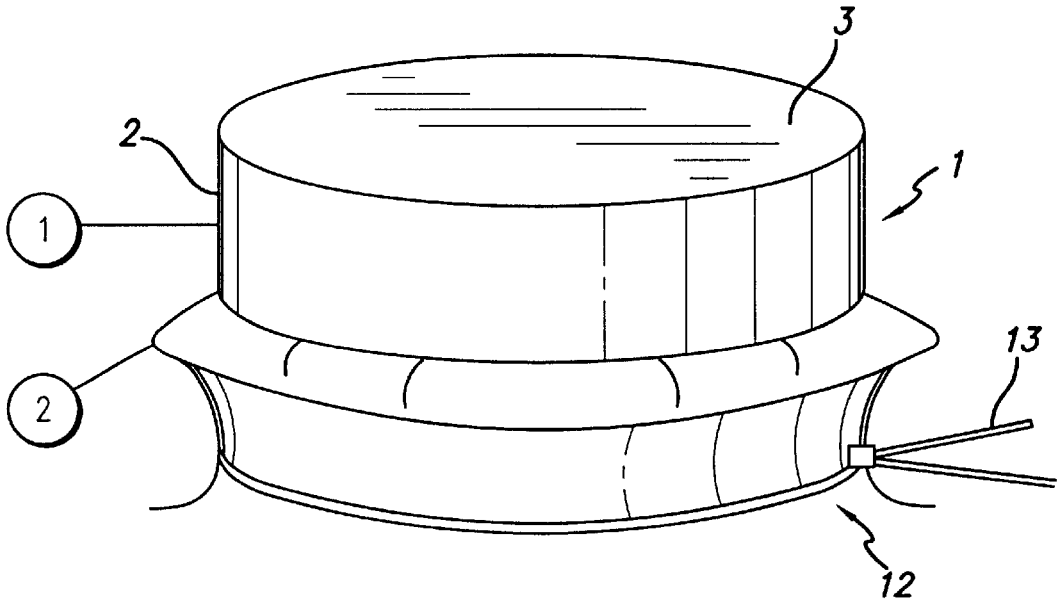
FIGS. 1A, 1B, 1C, and 1D show a first closure system embodiment with a bellows-driven arm/closure.
Figure 1B:
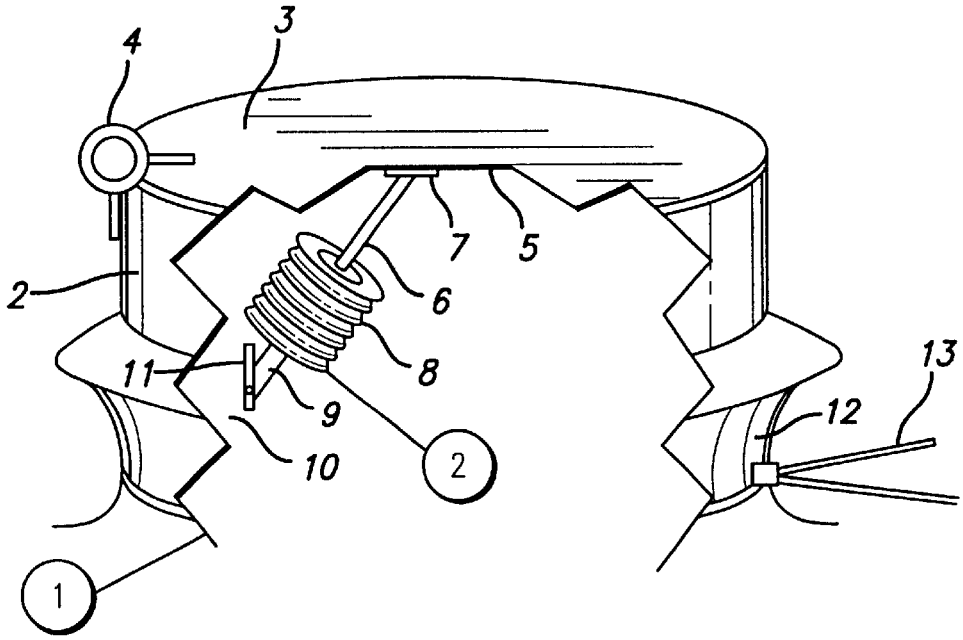
Figure 1C:
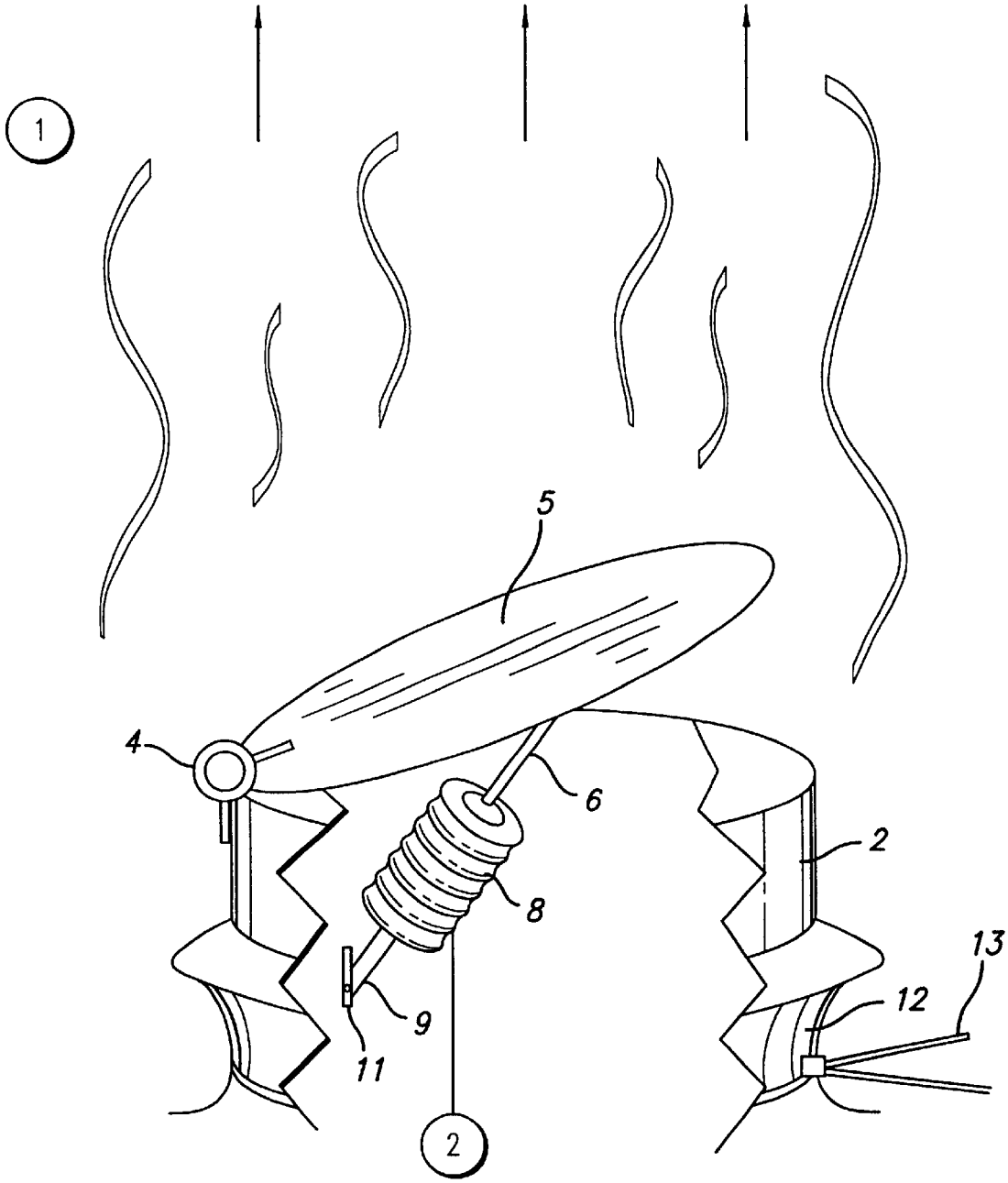

FIG. 1A shows closure device 1 attached to a bag of lettuce 12 with a twist tie 13. Container 1 includes cylindrical body portion 2 and closure 3. Closure 3 (see FIG. 1B), includes hinge 4 connected at one end to closure 3 and to an adjacent edge of body portion 2. Closure 3 has an arm member 6 connected at attachment point 7 to inner surface 5. Arm member 6 is also connected to sealed bellows 8. Bellows 8 is also connected to arm member 9. Arm member 9 is attached to the inner side wall 10 of closure system 1 at attachment point 11. As FIG. 1C shows, when bellows 8 expands, arm members 6 and 9 move closure 3 to an open position, permitting gases inside bag 12 to escape. Bellows 8 expands when the pressure surrounding bag 12 and closure device 1 falls below atmospheric pressure inside a vacuum chamber.

Figure 1D:
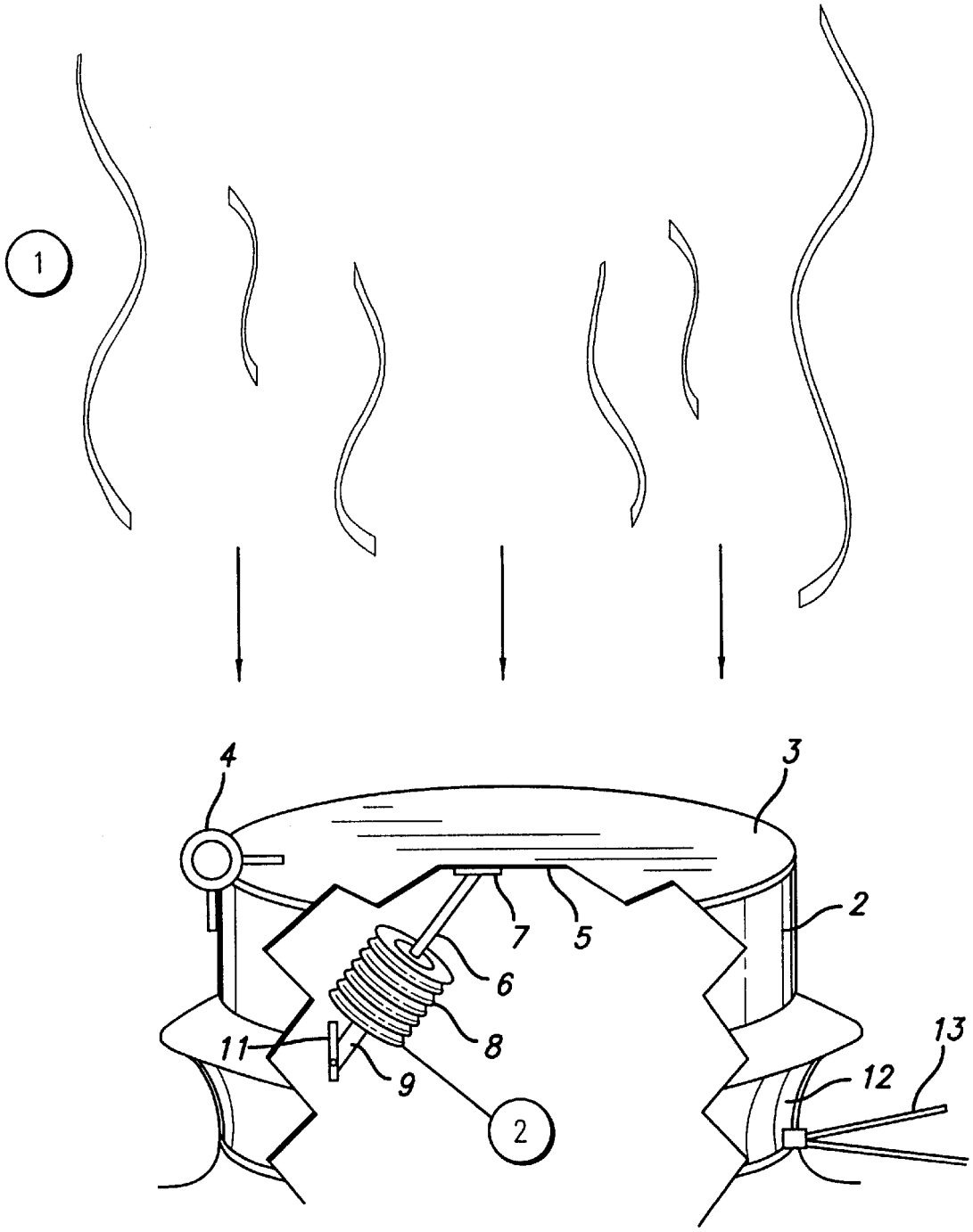
Figure 2A:
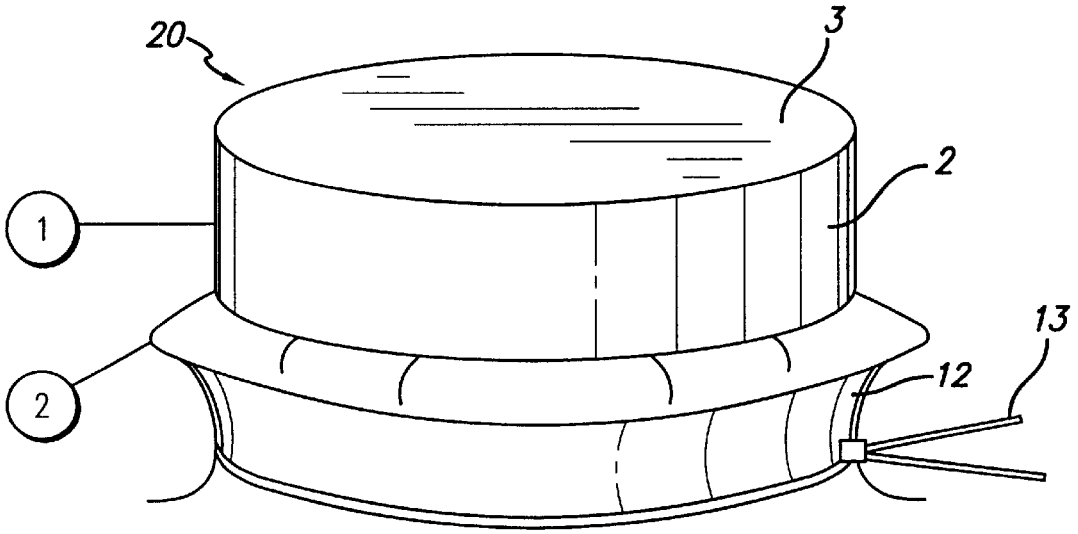
FIGS. 2A, 2B, 2C, and 2D show a second closure system embodiment with another bellows-driven arm/closure.
Figure 2B:
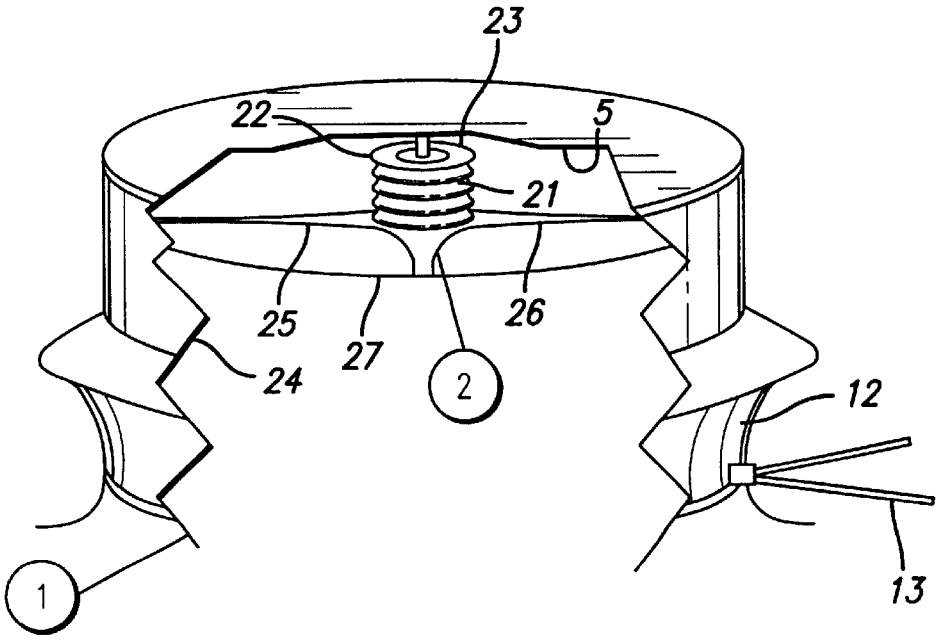
Figure 2C:
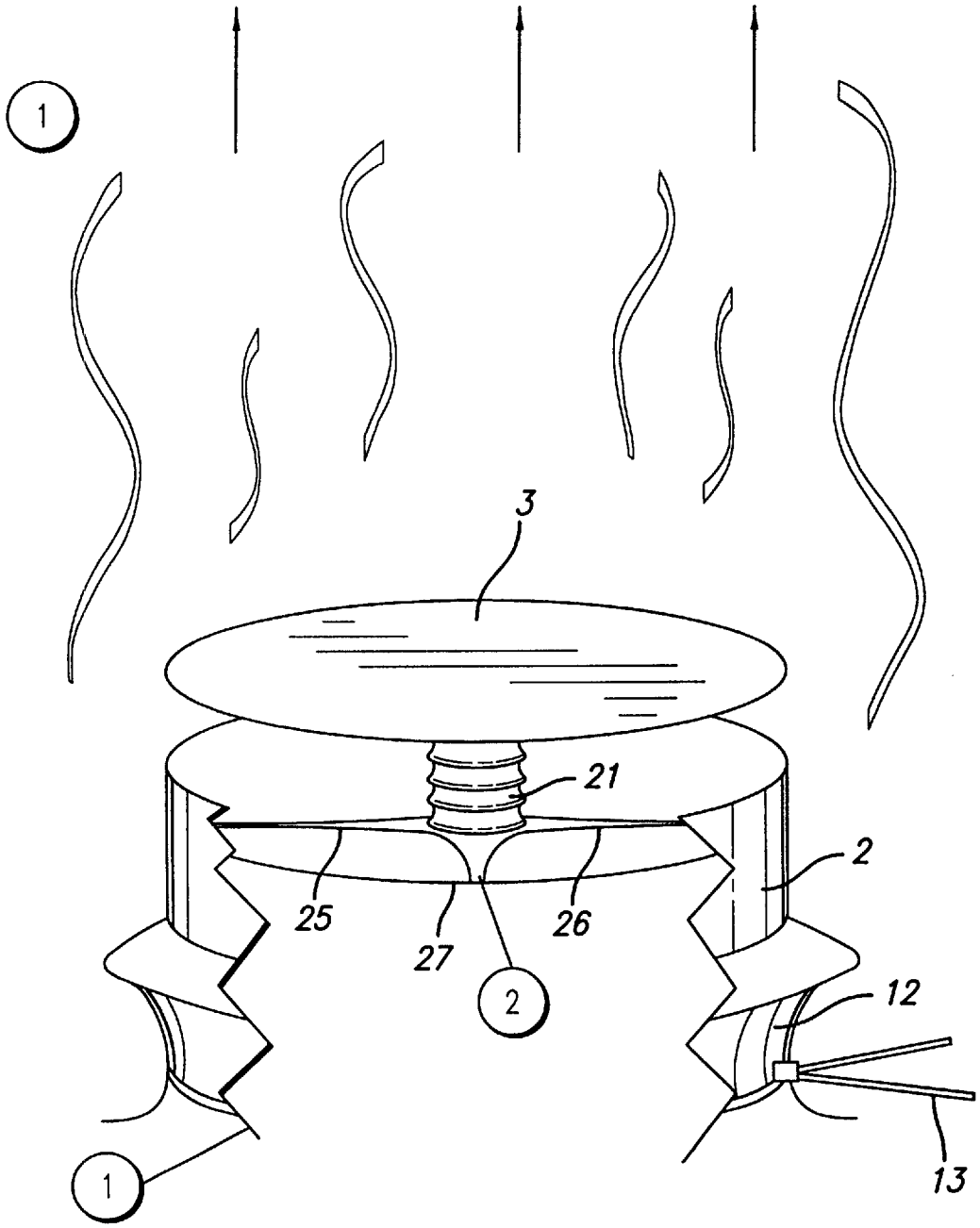
Figure 2D:
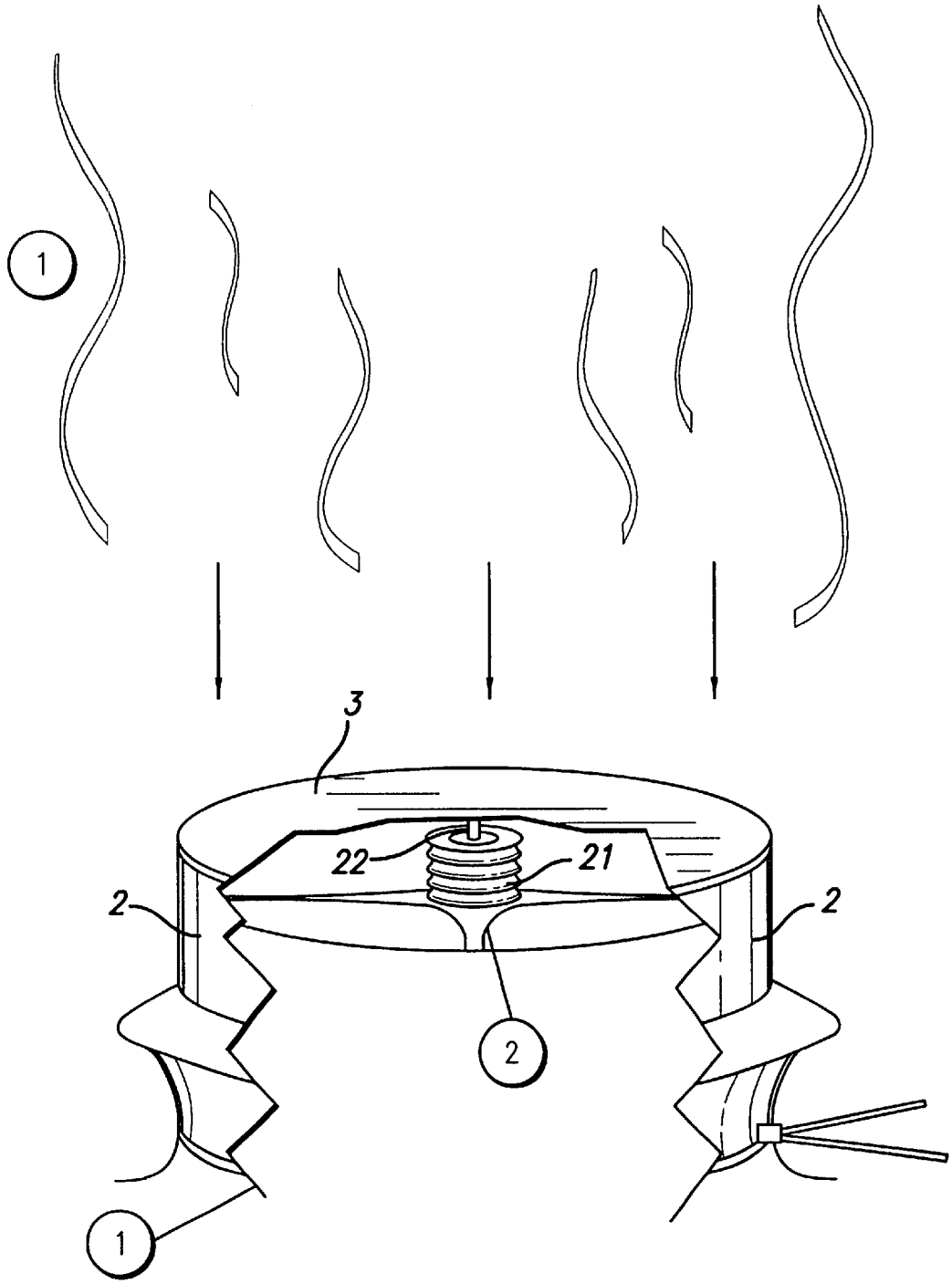

As FIG. 1D shows, when the pressure inside such a chamber is at atmospheric pressure, closure 3 assumes the closed position as the air inside bellows 8 contracts, moving arm members 6 and 9 and closure 3 to the closed position.

FIGS. 2A, 2B, 2C, and 2D, show closure device 20 with closure 3 and body portion 2 connected to produce bag 12 by twist-tie 13. Bellows 21 is connected through arm member 22 to the inner surface 25 of closure 3 at connection point 23. Bellows 21 is connected to the inner side walls 24 of body portion 2 through arm members 25, 26, and 27. Closure 3 moves to an open position as the air inside bellows 21 expands, which occurs when bag 12 and attached closure device 20 are subjected to a vacuum in a vacuum chamber. When the pressure inside such a vacuum chamber is at atmospheric pressure, bellows 21 contracts from the position shown in FIG. 2C to the position shown in FIG. 2D, moving closure 3 to the closed position.

Figure 3A:
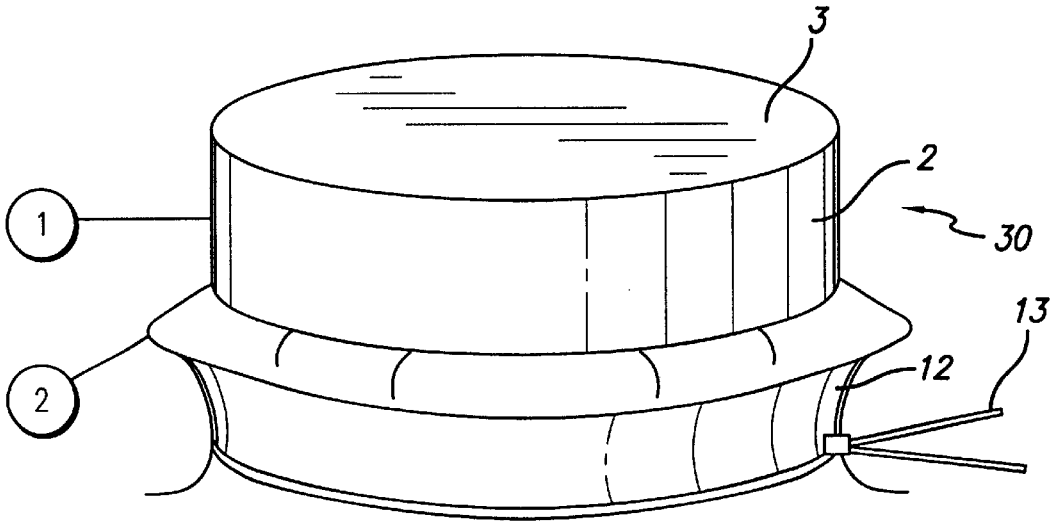
FIGS. 3A, 3B, 3C, and 3D show a third closure system embodiment with a bladder-driven arm/closure.
Figure 3B:
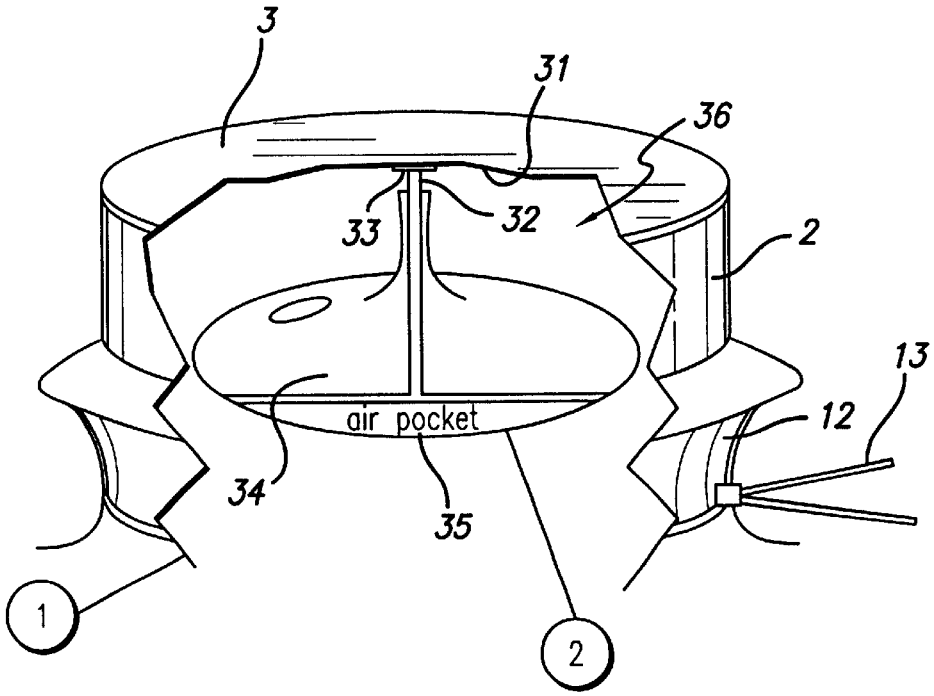
Figure 3C:
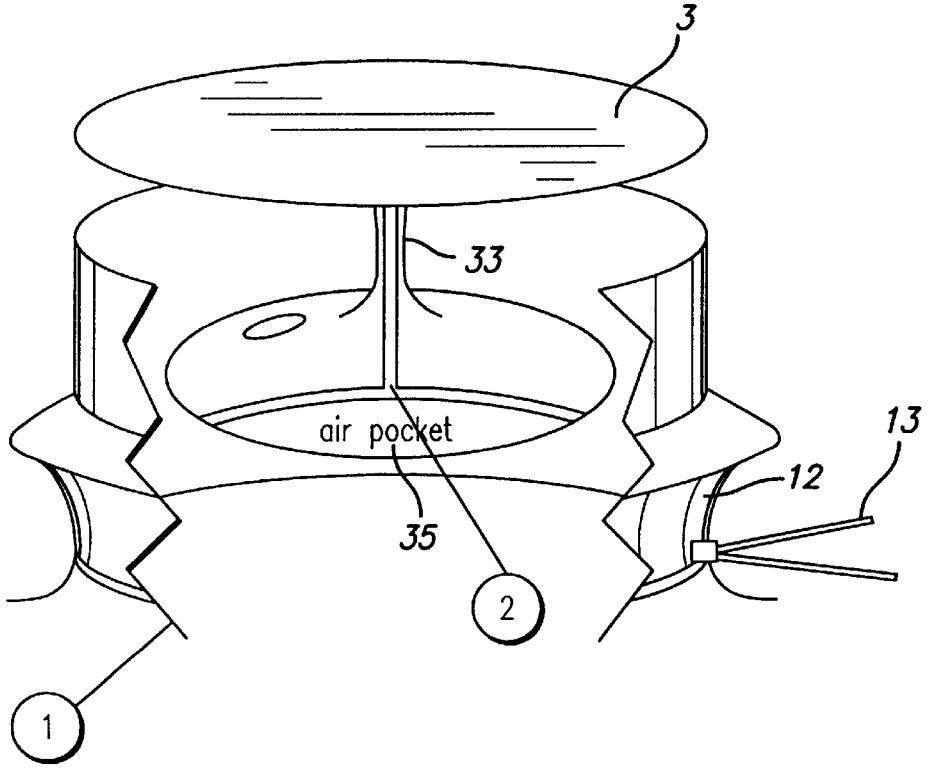
Figure 3D:
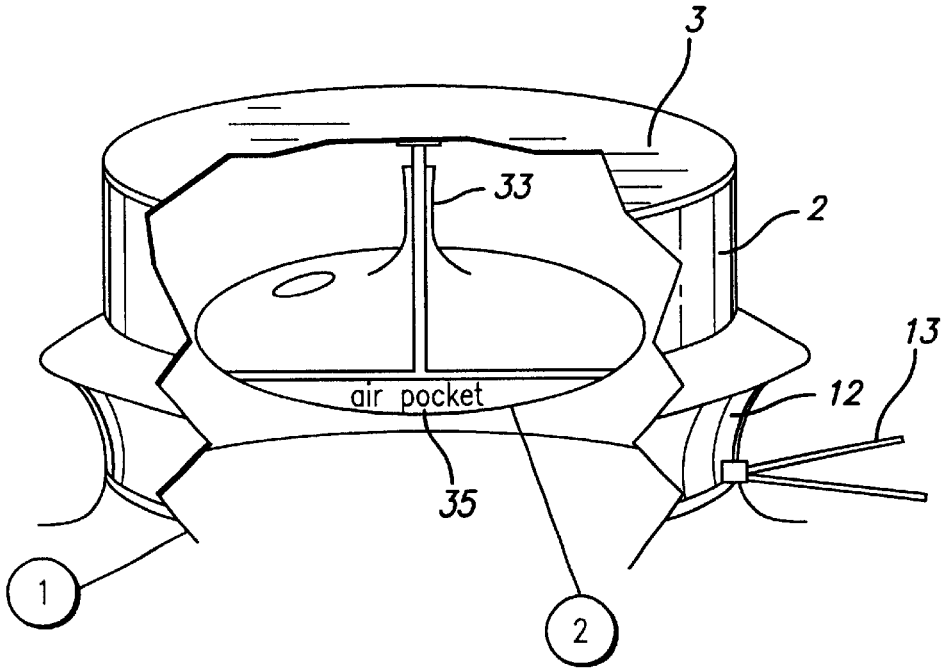

FIGS. 3A, 3B, 3C, and 3D show closure device 30, including body portion 2 and closure 3. Device 30 is attached to bag 12 by twist-tie 13. Connected to inner surface 31 of closure 3 at connection point 33 is arm member 32. Arm member 32 in turn is connected to sealed bladder 34 which includes air pocket 35. Bladder 34 is connected at connector point 36 to the interior surface of body portion 2. Inside a vacuum chamber, at reduced pressure, air pocket 35 expands, moving arm member and closure 3 to an open position. As shown in FIG. 3D, when pressure inside the vacuum chamber is at atmospheric pressure, the air inside bladder 35 contracts, moving arm member 32 and closure 3 to a closed position atop body portion 2.

Figure 4A:
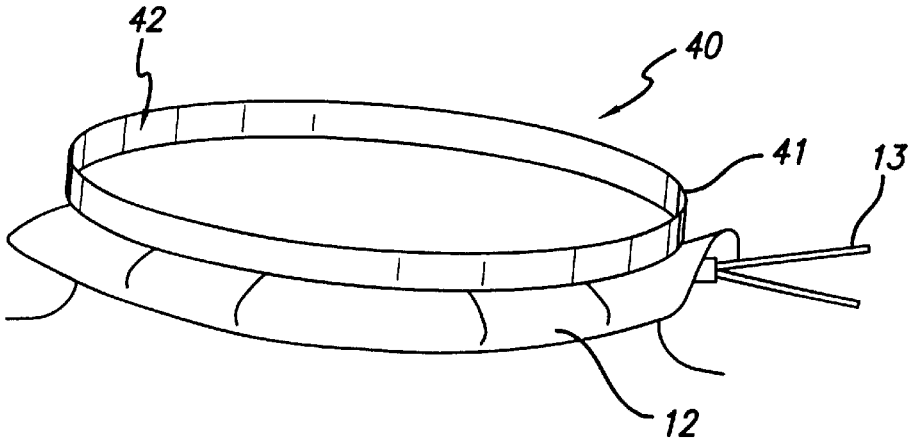
Figure 4B:
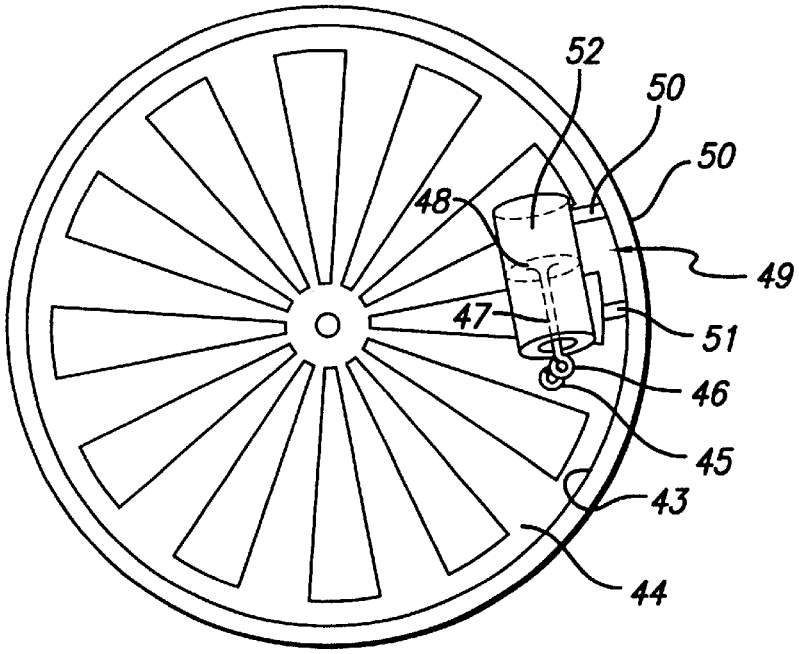
Figure 4E:
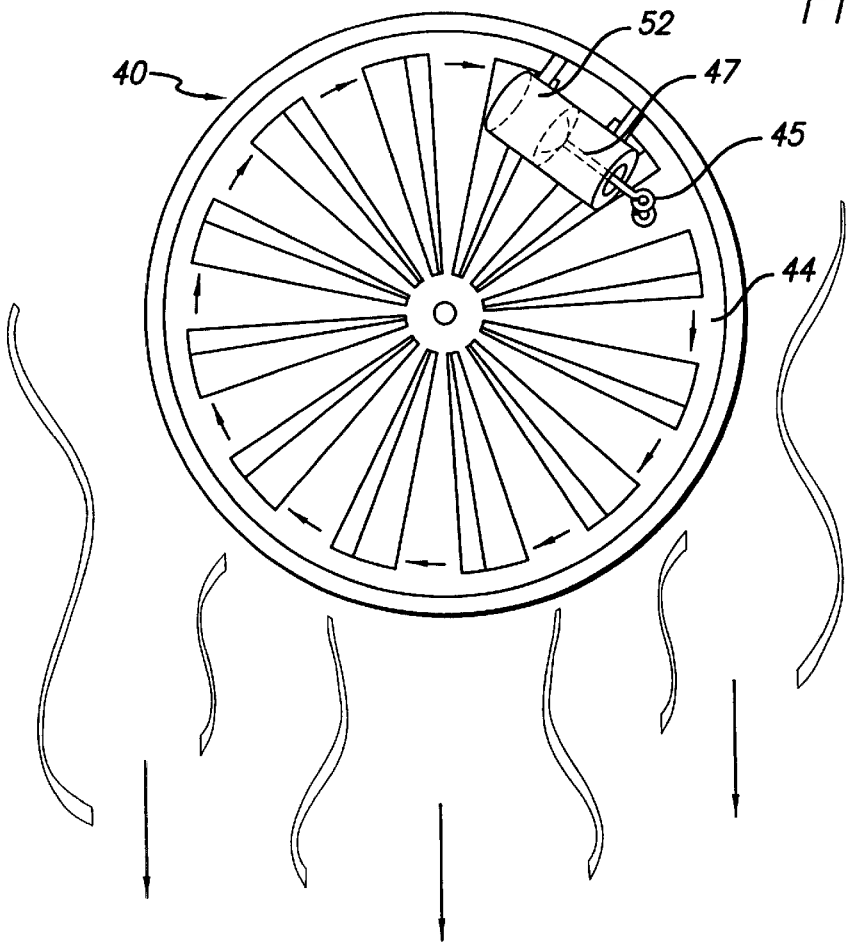
Figure 4F:
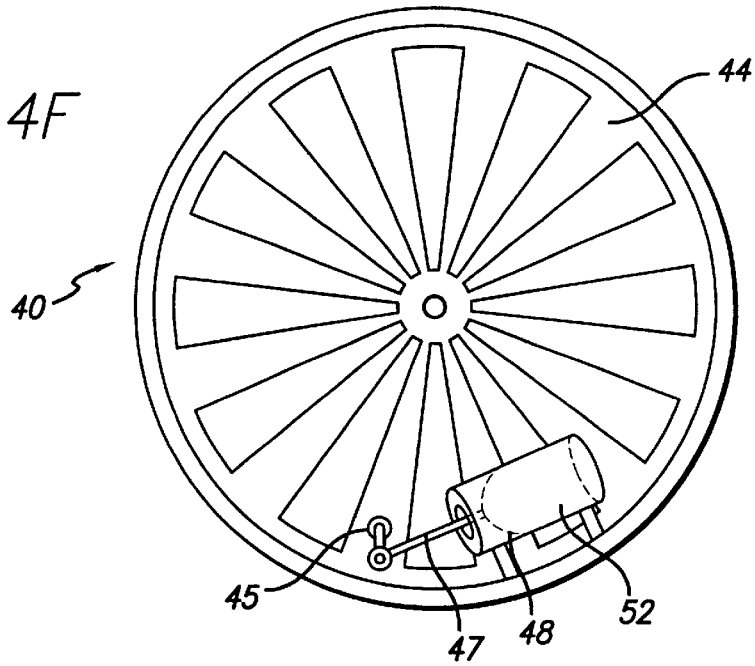
Figure 5A:
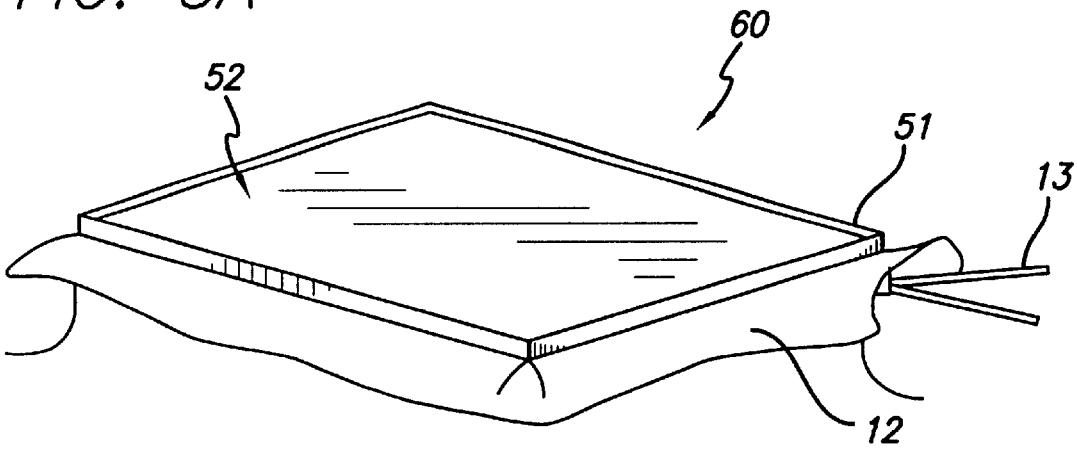
Figure 5B:
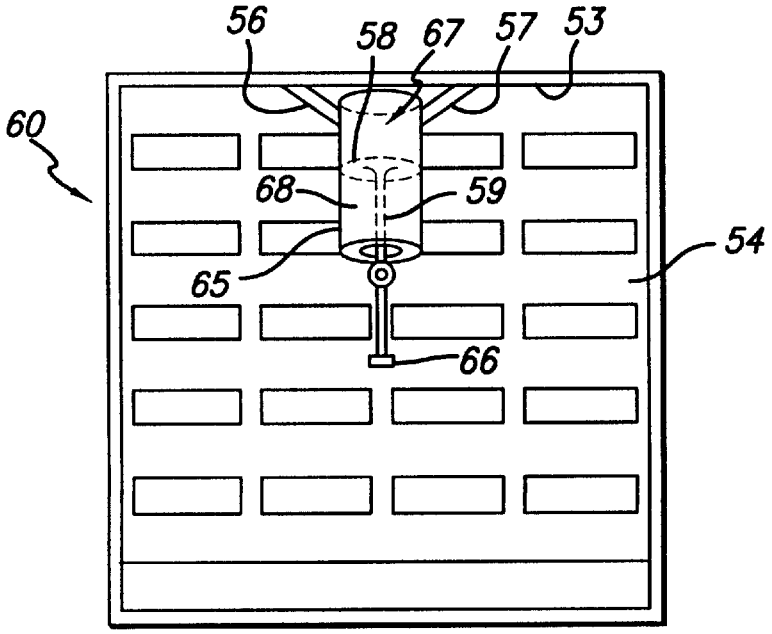
Figure 5C:
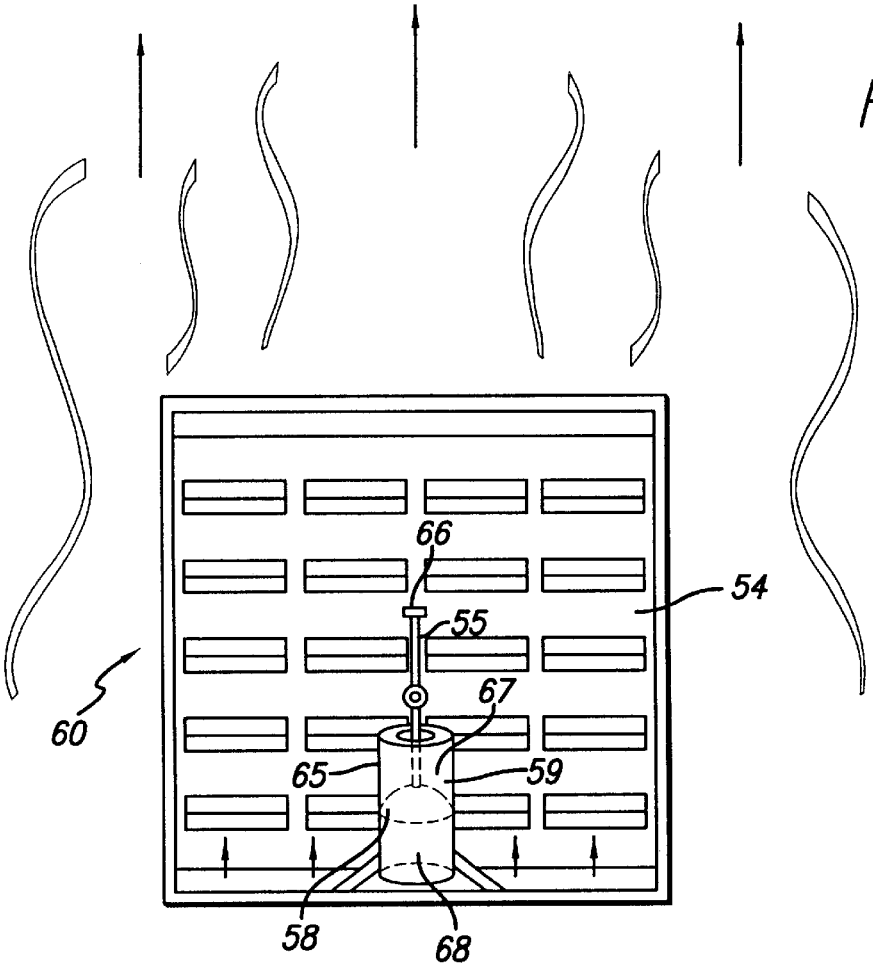
Figure 5D:
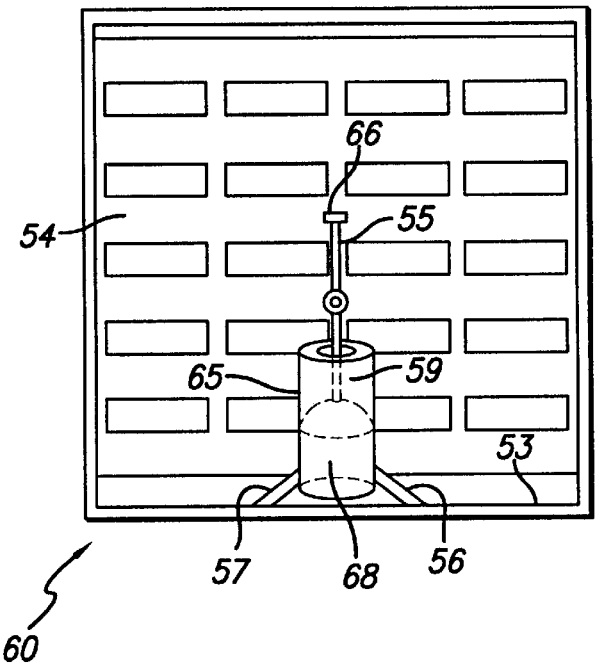

FIGS. 4A, 4B, 4C, 4D, 4E, and 4F show closure device 40 including body portion 41 and closure 42. Device 40 is attached to bag 12 by twist-tie 13. Connected to the inner surface 43 of closure 42 at connection point 45 is piston arm 47, connected in turn to piston 48 inside air cylinder 49. Connectors 50 and 51 connect cylinder 49 to the interior surface of body portion 41. See FIGS. 4A and 4B. Inside a vacuum chamber, at reduced pressure, air inside cylinder 49 within region 52 expands, moving piston arm 47 and closure 44 to an open position. See FIGS. 4C and 4D. As pressure inside the vacuum chamber returns to atmospheric pressure, the air inside space 52 contracts, moving piston arm 47, and closure 44 to a closed position atop body portion 41, as FIGS. 4E and 4F show.

FIGS. 5A, 5B, 5C, 5D, 5E and 5F show closure device 50 including body portion 51, and closure 52. Device 50 is attached to bag 12 by twist-tie 13. Connected to inner surface 53 of closure 52 at connection point 66 is piston arm 55. Piston arm 55 in turn is connected to piston 58 inside cylinder 65. Piston 58 separates air space 59 from closed air space 67. Cylinder 65 is linked to the interior surface of body portion 51 by connectors 56 and 57. See FIGS. 5A and 5B. Inside a vacuum chamber, at reduced pressure, the air in space 67 expands, moving piston arm 55, and closure 52 to an open position. See FIGS. 5C and 5D. When the pressure inside the vacuum chamber returns to atmospheric pressure, the air inside space 67 contracts, moving piston arm 55, and closure 52 to a closed position atop body portion 2. See FIGS. 5E and 5F.

What is claimed is:

1. A method for filling a sealed bag of fresh produce with a desired gas or gas mixture comprises:

attaching a closure device to an open end of said bag, said closure device comprising at least one opening through each of which gas will flow in or out of said bag;

placing said bag with its attached closure device entirely inside a vacuum chamber;

closing said vacuum chamber to the outside atmosphere;

drawing a vacuum within said vacuum chamber, sufficient to reduce the pressure inside said chamber below atmospheric pressure to open said at least one opening of said closure device, exposing the interior of said bag to the inside of said vacuum chamber and then;

filling said vacuum chamber and the interior of said bag of produce inside said vacuum chamber with a desired gas or gas mixture, and increasing the pressure inside said chamber to or near to atmospheric pressure, to close said at least one opening of said closure device, and seal said desired gas or gas mixture inside said bag of fresh produce.

2. The method of claim 1 further comprising opening said vacuum chamber, removing said bag from said vacuum chamber, removing said closure device from said bag of produce, and sealing said bag with said desired gas or gas mixture inside said bag.

3. The method of claim 1 further comprising opening said vacuum chamber, and removing said bag with said closure device attached thereto from said vacuum chamber.

* * * * *